United States Patent [19]

van de Grijp

[11] 4,157,516

[45] Jun. 5, 1979

[54] WAVE GUIDE TO MICROSTRIP TRANSITION

[75] Inventor: Abram van de Grijp, Eindhoven, Netherlands

[73] Assignee: U.S. Philips Corporation, New York, N.Y.

[21] Appl. No.: 829,619

[22] Filed: Sep. 1, 1977

[30] Foreign Application Priority Data

Sep. 7, 1976 [NL] Netherlands ..... 7609903

[51] Int. Cl.[2] ..... H01P 5/10

[52] U.S. Cl. ..... 333/26; 333/35; 333/246

[58] Field of Search ..... 333/21 R, 26, 32, 33, 333/35

[56] References Cited

U.S. PATENT DOCUMENTS

| | | | |
|---|---|---|---|
| 3,518,579 | 6/1970 | Hoffman | 333/21 R |
| 4,052,683 | 10/1977 | van Heuven et al. | 333/26 X |

*Primary Examiner*—Paul L. Gensler

*Attorney, Agent, or Firm*—Algy Tamoshunas

[57] ABSTRACT

A wave guide to microstrip transition is disclosed in which the substrate of the microstrip line is arranged parallel to and in the longitudinal direction of the wave guide. The microstrip conductor is connected to the wave guide wall by a strip-shaped conductor provided on the substrate and the base plate has a first portion which extends to the opposite wall and a second portion which is located opposite the strip-shaped conductor. The edge of the second portion forms with an edge of the strip-shaped conductor a high impedance transmission line so that a low-loss asymmetrical conductor structure is obtained.

6 Claims, 3 Drawing Figures

WAVE GUIDE TO MICROSTRIP TRANSITION

Figure 1:
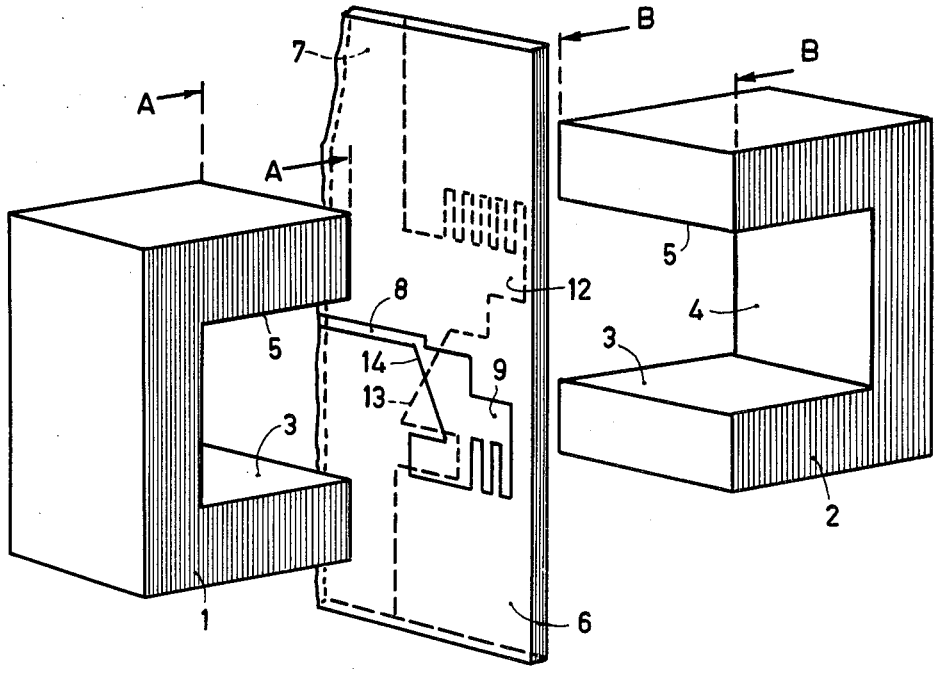

The invention relates to a wave guide to microstrip transition, comprising a wave guide, and a substrate arranged parallel to the electric field lines and in the longitudnal direction of the wave guide. The substrate has on one of its sides a conductive base plate and on the other side conductors which, together with the substrate and the base plate, form a microstrip conductor structure. A microstrip conductor is connected conductively at least for HF energy to a wall portion of the wave guide by a widening strip-shaped conductor provided on a part of the substrate extending in the wave guide from the microstrip conductor structure.

Such a microwave device is disclosed in Netherlands Published Patent Application No. 7402693, corresponding to U.S. Pat. No. 4,052,683 in which a further strip-shaped conductor coupled to the base plate is provided which, with respect to the center line of the wave guide, is mirror symmetrical to the strip-shaped conductor connected to the microstrip conductor. The mirror symmetrical conductor configuration forms an impedance transformer which matches the wave guide resistance to that of the microstrip conductor structure and a mode transformer which rotates the direction of the electrical field through 90°. In addition, on the side near the micro-strip conductor structure, it also forms a symmetrical band conductor which is coupled to the microstrip conductor structure by means of a symmetrical-asymmetrical transformer.

Although such a microwave device has a comparatively low forward attenuation and reflection coefficient, there exists in practice a need for such a device with even better properties.

It is the object of the invention to provide a new conception of the microwave device described in the preamble which meets this need.

The device according to the invention is characterized in that from a point disposed opposite to the connection point of the microstrip conductor structure or line and the strip-shaped conductor on the substrate on the one hand the base plate extends in a narrowing manner from the microstrip conductor structure to a wall portion of the wave guide disposed opposite to one wall portion and on the other hand extends to one wall portion and forms a transmission line with the edge of the strip-shaped conductor facing the microstrip conductor structure.

The invention is based on the recognition that the conductor configuration of such a device need not be symmetrical. One advantage of such a construction is that it avoids losses which in the known device, result from a symmetrical conductor configuration, for example, losses occurring in the impedance formed by the space which is bounded by the base plate and the strip-shaped conductor coupled thereto. The construction of the invention also obviates the need for the frequency-selective symmetrical-asymmetrical transformer disposed in the signal path and required as a result of the symmetrical band conductor in the known device further reducing losses.

In an advantageous embodiment of a microwave device according to the invention the edges of the conductors which form the transmission line together with one wall portion of the wave guide enclose a triangle. This triangular conductor configuration forms a transmission line having a high input and a high average characteristic impedance.

A further improvement is obtained when the length of the triangular transmission line corresponds to approximately $\frac{1}{4}\lambda$ of a homogeneous transmission line at the operating frequency and one wall portion of the wave guide forms a shortcircuit at the base of the triangle between the two limbs. The input impedance of the transmission line at the center of the frequency band is thus infinitely large, which gives a further reduction of the transmission losses.

In a particularly advantageous embodiment of the device the substrate is clamped between slots provided in the wave guide wall portions and the conductors extending on the substrate to the wall portions are elongated at least partly by a serrated conductor structure having a depth of approximately $\frac{1}{4}\lambda$ at the operating frequency. The serrated conductors are arranged in the slots so as to be insulated from the wave guide wall portions and form a serrated choke. The widening strip-shaped conductor is provided with a first conductor strip wich extends in the direction of the microstrip conductor structure and the base plate is provided with a second conductive strip partly opposite the first strip. The two strips are arranged so as to be insulated from the wave guide wall portions and form an approximately $\frac{1}{4}\lambda$ long further transmission line at the operating frequency of the device. The distance between said point and the further transmission line is approximately $\frac{1}{4}\lambda$ the operating frequency. This transmission line has a low characteristic impedance and as a result of this the impedance at the open end of the further transmission line, which in practice deviates from infinity is transformed to the input of the transmission line formed by the triangular configuration. The value of the transformed input impedance exceeds the value of the open end of the transmission line deviating from infinity by a factor which is equal to the square of the ratio of the high characteristic impedance of the triangular transmission line and the low characteristic impedance of the further transmission line, resulting in low dissipation over a wide frequency range.

The invention and its advantages will now be described in greater detail with reference to embodiments shown in the Figures in which corresponding parts in the various Figures are referred to by the same reference numerals.

Figure 2:
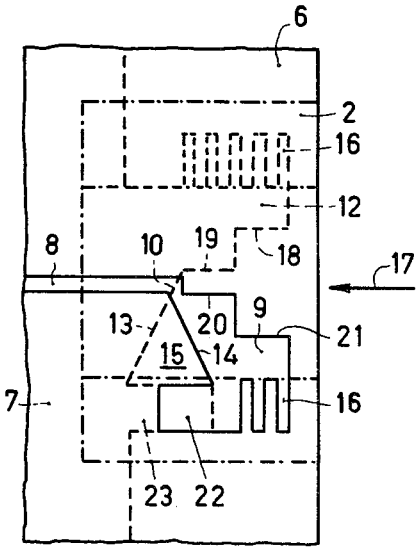
Figure 3:
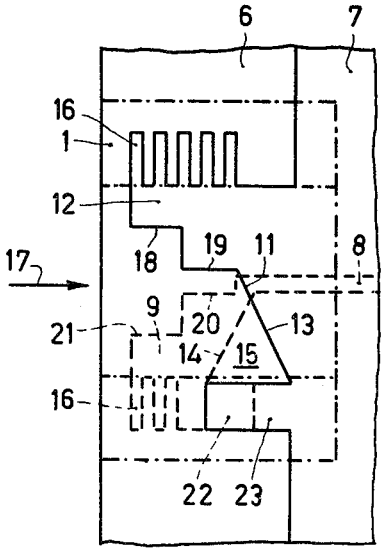

FIG. 1 is a perspective view of a microwave device according to the invention in which the various components from which the device is composed are shown in their mutual positions, FIG. 2 is an elevation of the microwave device shown in FIG. 1 taken on the cross-sectional line A—A, FIG. 3 is an elevation of the microwave device shown in FIG. 1 taken on the cross-sectional line B—B.

The microwave device shown in FIG. 1 comprises a rectangular wave guide which may, for example, be milled, from two blocks of conductive material. The faces of blocks 1 and 2 which are visible in the Figure and form the walls of the wave guide are identified by reference characters 3 and 4. The central plane between the blocks 1 and 2 in the assembled condition is formed by a symmetry plane of the wave guide which is parallel to the electrical field lines and the longitudinal axis of the wave guide.

Arranged in the plane of symmetry between block 1 and 2 is a substrate 6 of, for example, dielectric or gyromagnetic material. In this embodiment the blocks 1 and 2 are insulated from direct contact with the substrate and the conductor structures provided thereon, for example, by means of dielectric foils etc. not shown. In this embodiment the substrate projects beyond the wave guide. Alternatively the substrate may be smaller than the wave guide, so that it is disposed entirely within the wave guide.

The substrate 6 has conductor patterns on both sides which are provided, for example, by selective growth of metal or etching away metal layers originally covering the two side faces entirely. The conductor patterns will be explained in detail with reference to the elevations shown in FIGS. 2 and 3 of the cross-sectional views A—A and B—B of the device shown in FIG. 1. The conductor patterns on the front of the substrate 6 as viewed in the Figures are denoted by solid lines and conductor patterns on the rear are denoted by broken lines. All wave guide portions disposed behind the substrate are shown by dot-and-dash lines.

One of the conductors is formed by a base plate 7 which partly covers one side of the substrate 6 and another conductor is formed by a microstrip conductor 8 provided on the opposite side. Conductor 8 together with the base plate 7 and the substrate 6 form the microstrip conductor structure or line. In FIG. 2 the microstrip structure extends farther to the left, to the bottom and to the top and in FIG. 3 to the right, to the bottom and to the top, and the microstrip conductor 8 may have any form. However, it is possible to choose different dimensions of the structure in each of the devices.

For optimum coupling of the microstrip structure to the waveguide, conductor 8 is connected conductively, at least for HF signals, via a widening strip-shaped conductor 9, to the lower wall 3 of the wave guide. The base plate 7 extends from point 11, opposite to the connection point or junction 10 between conductors 8 and 9, to the lower wave guide wall 3 and has a narrowing portion 12 which extends from point 11 to the upper wave guide wall 5.

An aperture 15 is enclosed by the part 13 of the edge of the base plate and the part 14 of the edge of the strip-shaped conductor 9.

In order to obtain a good connection for HF signals which is not critical and which can be realized in a simple manner, the portions of conductors 9 and 12 adjacent the respective wave guide walls have tooth-shaped configurations 16. In a known manner, the height of the teeth height is approximately a quarter of the wavelength at the operating frequency of the device. The spaces between the teeth, which are open at one, side form $\frac{1}{4}\lambda$ transformers which transform the high impedance of the open ends to a low impedance at the area of the lower and upper wall of the wave guide. Even with small deviation from the ideal assembly position of the substrate 6 in the wave guide, this construction provides a very good HF contact between the wave guide walls and the conductors 9 and 12.

The operation of the device is as follows. The electric field lines of a $TE_{10}$ mode in a rectangular wave guide are normal to the upper and lower walls 3 and 5, that is, they are situated in the plane of the FIGS. 2 and 3. The maximum intensity of the electric field in such a wave is at the location of the substrate so that the field is coupled strongly to the conductors 9 and 12. In the direction of wave propagation which in FIGS. 2 and 3 is shown by an arrow 17, the field lines move along the edges of the conductors 9 and 12 and rotate out of the plane of the drawing until the field corresponds to the electric field strength of the mode of oscillation of said structure at the area of the microstrip conductor structure 7, 8. Apart from the fact that conductors 9 and 12 convert the wave guide mode into that of the microstrip structure, the conductors also form an impedance transformer which matches the wave guide impedance of approximately 400 ohm to the impedance of the microstrip line of approximately 50 ohm. It is to be noted that due to the reciprocal structure ofthe device, it operates identically for wave propagation in a direction opposite to that of arrow 17.

The facing edges 18, 19 and 20, 21 of conductors 9 and 12, are approximately $\frac{1}{4}\lambda$ long at the operating frequency and are parallel to and at such a distance from the wave guide walls 3 and 5 that a two-section-long impedance transformer is obtained with minimum ripple. The most important advantage of this configuration is that the dimension of the microwave device in the longitudinal direction of the wave guide is very small.

As stated above, an aperture 15 is enclosed by the edge 14 of conductor 9 and edge 13 of the base plate 7. The edges 13 and 14 together with the aperture form a transmission line which is connected in parallel to the wave guide at the area of the points 10 and 11, and which has a high input impedance.

As a result of this high impedance, the ground of the asymmetric microstrip conductor structure is insulated from the symmetrical wave guide structure. However, this impedance results in some dissipation. In order to further improve the insulation and to further reduce the dissipation, the length ofthe inhomogeneous transmission line 13, 14, 15 is chosen to correspond approximately to the length of a $\frac{1}{4}\lambda$ long homogeneous transmission line at the operating frequency of the device and is short-circuited, at least for HF-signals at the area of the waveguide wall.

As shown in the Figures, the aperture 15 in this embodiment is triangular but is not restricted thereto. The triangular shape of the transmission line 13, 14, 15 combines the favourable properties of a high characteristic impedance at the area of the base (wave guide wall) to a low field interference at the top (the points 10 and 11).

Conductor 9 is further provided with a strip 22 and the base plate 7 is provided with a strip 23 which are disposed opposite each other and in this embodiment are positioned in the slot between the walls of the wave guide portions 1 and 2. It is to be noted that the strip need not be positioned in the slot. Its location is determined by the point s 10 and 11 and the length of the transmission line 13, 14, 15. The strips 22 and 23 form a further open transmission line approximately $\frac{1}{4}\lambda$ long at the operating frequency of the device which has a low characteristic impedance due to the dimensions of the strips.

The transmission line 22, 23, provides, in a structurally simple manner, a shortcircuit impedance for the transmission line 13, 14, 15. The value of the impedance of the open end of transmission line 22, 23, which deviates from infinity in practice is transformed to a high impedance at the area of the points 10 and 11 by means of the $\frac{1}{4}\lambda$ long transmission line 22, 23 and 13, 14, 15, which impedance exceeds that of the open end of transmission line 22, 23 by a factor equal to the square of the ratio of the high characteristic impedance of the transmission line 13, 14, 15 and the low characteristic impedance of the transmission line 22, 23.

As will be apparent from the above description, according to the invention, the microwave device has only one aperture 15 which is porportioned so as to dissipate as little as possible over a frequency range which is as wide as possible. The transmission losses of the device therefore are approximately 0.14 dB in the frequency range from 18 to 26 GHz and the reflection coefficient is smaller than 1.16 over said frequency range.

It is to be noted that wave guides other than rectangular ones, for example circular or elliptical wave guides, may also be used so long as in said guides oscillations are generated the electrical field lines of which are parallel to the substrate.

What is claimed is:

1. A wave guide to microstrip transition comprising a wave guide, a generally planar substrate arranged in said wave guide parallel to the electric field lines and the longitudinal direction of said wave guide, a conductive base plate affixed to one side of said substrate, a first conductor affixed to the other side of said substrate opposite said base plate and defining with said substrate and said base plate a microstrip line, a second conductor affixed to said other side of said substrate and connected to said first conductor at a junction therebetween, said second conductor extending from said junction to a first wall portion of said wave guide and connecting said first conductor to said first wall portion, said base plate having a portion which extends from a point opposite said junction and is connected to a second wall portion of said wave guide, said second wall portion being disposed opposite said first wall portion, said base plate having a further portion which extends from said point to said first wall portion, said further portion and said second conductor each having an edge which extends from said point and said junction, respectively, to said first wall portion and being configured such that said edges define a transmission line which presents a high impedance at the region of said junction and said point.

2. The transition according to claim 1 wherein an end portion of said transmission line remote from said said region is short-circuited by said first wall portion and the length of said line is approximately $\frac{1}{4}\lambda$ at the operating frequency.

3. The transition according to claim 1 wherein said edges defining said transmission line and said first wall portion form a triangle.

4. The transition according to claim 1 including means for short-circuiting said transmission line at a location therealong such that the electrical length of said line at the operating frequency is approximately $\frac{1}{4}\lambda$.

5. The transition according to claim 4 wherein said short-circuit means includes a pair of conductive strips disposed opposite each other and affixed to opposite sides of said substrate, said strips together with said substrate defining an open circuited transmission line, said open circuit line being connected to said first-named transmission line at said location and having a length of approximately $\frac{1}{4}\lambda$ at the operating frequency.

6. The transition according to claim 1 wherein said first-named portion of said base plate has an edge extending from said point and said second conductor has a further edge extending from said junction, said further edge being parallel to and spaced from said edge of said first-named portion to define therewith a quarter wave length impedance transformer.

* * * * *